US005362618A

United States Patent [19]

Ishikawa et al.

[11] Patent Number: 5,362,618

[45] Date of Patent: Nov. 8, 1994

[54] SILVER HALIDE PHOTOGRAPHIC LIGHT-SENSITIVE MATERIAL

[75] Inventors: Sadayasu Ishikawa; Shigetami Kasai; Yasuo Honda, all of Hino, Japan

[73] Assignee: Konica Corporation, Japan

[21] Appl. No.: 94,454

[22] Filed: Jul. 19, 1993

[30] Foreign Application Priority Data

Jul. 23, 1992 [JP] Japan ..... 4-197168

[51] Int. Cl.[5] ..... G03C 1/005; G03C 1/015

[52] U.S. Cl. ..... 430/567; 430/569

[58] Field of Search ..... 430/567, 569

[56] References Cited

U.S. PATENT DOCUMENTS 4,999,282 3/1991 Sato et al. ..... 430/569

5,124,243 6/1992 Mochizuki et al. ..... 430/567

*Primary Examiner*—Charles L. Bowers, Jr.

*Assistant Examiner*—Mark F. Huff

*Attorney, Agent, or Firm*—Jordan B. Bierman

[57] ABSTRACT

A silver halide photographic light-sensitive material is provided, comprising silver halide-grains which meet the following requirements:

(1) the silver halide grains are formed from seed crystals through the growth of the crystals, wherein a silver halide phase formed in each grain, before 30% of the addition amount of silver is supplied, is formed while the intergrain distance of individual silver halide grains contained in the reaction liquor being kept within a range of 0.1 to 2.0 $\mu$m;

(2) the silver halide grains each have, in respect of distance L from the grain center to the grain surface, a point at which the content of silver iodide becomes maximum within distance $L_1$ from the grain center to 0.67 L, and a point at which the content of silver iodide becomes minimum within distance $L_2$ from 0.58 L to the grain surface and, in each grain, the silver iodide content shows a substantially monotonous decrease in the range from $L_1$ to $L_2$, and $(L_2-L_1)/L>0.20$ is satisfied.

8 Claims, No Drawings

SILVER HALIDE PHOTOGRAPHIC LIGHT-SENSITIVE MATERIAL

FIELD OF THE INVENTION

The present invention relates to a silver halide emulsion useful in photographic applications and a silver halide photographic light-sensitive material which uses the emulsion. More particularly, the present invention relates to a silver halide photographic light-sensitive material high in sensitivity, improved in fog density and graininess, and excellent in pressure resistance.

BACKGROUND OF THE INVENTION

In recent years, there has been an increasing demand for high performances in a silver halide photographic light-sensitive material, and further improvements are strongly demanded toward much higher photographic properties, particularly toward higher sensitivities, lower fog densities and higher image qualities.

In association with such tendencies towards higher sensitivities and higher image qualities, improvements towards higher pressure resistances are also demanded of a silver halide photographic light-sensitive material.

In general, a silver halide photographic light-sensitive material (hereinafter occasionally abbreviated as a light-sensitive material) is subjected to various types of pressure, for example, mechanical stresses such as bending and rubbing applied to a light-sensitive material in the processes of manufacturing, cutting and processing as well as at the time of loading it into a cartridge or a camera.

As is well known, application of such stresses causes pressure fogging (also termed pressure sensitization) or lowering of sensitivity (pressure desensitization) of a light-sensitive material; accordingly, there is a strong demand for a light-sensitive material which is immune from deterioration in photographic properties when subjected to pressure.

Among various methods which have so far been proposed as measures for improving the pressure resistance, methods which improve the pressure resistance of silver halide grains themselves are regarded to be more practical and more effective than methods which alleviate external pressure exerted on silver halide grains by use of a polymer or a plasticizer.

Accordingly, there has actively been studied in recent years the use of emulsions comprising core/shell-type silver halide grains having a silver iodobromide phase of high silver iodide content in the core. For example, Japanese Pat. O.P.I. Pub. Nos. 99433/1984, 35726/1985 and 147727/1985 disclose color negative films improved in pressure resistance by use of core/shell-type silver iodobromide grains having, inside of the grains, a high silver iodide content phase comprising 10 mol % or more silver iodide.

In the preparation of such core/shell-type silver halide grains, the formation of high iodide content cores needs to increase the growth rate of silver halide grains by raising the solubility of silver halide during the growth to compensate the low solubility of silver iodide.

As typical means to raise the solubility, there are known elevating the temperature during the mixing process, adding a silver halide solvent, and raising the pH and pAg during the mixing process.

However, core/shell-type emulsions have problems that silver halide grains are liable to aggregate in the process of manufacturing emulsions during which iodides necessary to form high iodide content cores are added to a reaction system, and that emulsions after grains are grown are apt to fog and deteriorate in graininess.

Further, Japanese Pat. O.P.I. Pub. NO. 943/1990 discloses a technique to obtain an emulsion of high sensitivity and low pressure fogging property by continuously changing the iodide content inside of grains, without giving a clear core/shell structure to grains. However, this technique has a disadvantage of greatly deteriorating pressure desensitizing resistance, though it brings about improvements in pressure fogging.

As stated above, it is not easy to develop a light-sensitive material having a high sensitivity, a high resolution and improved resistances to pressure fogging and pressure desensitizing and, therefore, a new technique has been strongly sought for the development of such a light-sensitive material.

SUMMARY OF THE INVENTION

Accordingly, an object of the present invention is to provide a silver halide emulsion high in sensitivity, low in fogging, excellent in graininess and improved in resistances to pressure fogging and pressure desensitizing as well as a silver halide photographic light-sensitive material which uses the silver halide emulsion. Other objects of the present invention will become apparent from the detailed description to follow.

As the result of studies directed to the solution of the problems, the present inventors have found that the foregoing object of the invention is attained by the following constituents.

A silver halide photographic light-sensitive material having at least one silver halide emulsion layer on a support, wherein said emulsion layer contains silver halide grains which satisfy the following requirements (1) and (2):

(1) the silver halide grains are formed from seed crystals through the growth of the crystals, and the silver halide phase of each silver halide grain, which is formed before 30% of the amount of silver salt to be added is supplied, is formed within a range of 0.1 to 2.0 μm in terms of the intergrain distance of individual silver halide grains contained in the reaction liquor, and (2) the silver halide grains each have, in respect of distance L from the grain center to the grain surface, a point at which the content of silver iodide becomes maximum within distance $L_1$ from the grain center to 0.67 L, and a point at which the content of silver iodide becomes minimum within distance $L_2$ from 0.58 L to the grain surface and, in each grain, the silver iodide content shows a substantially monotonous decrease in the range from $L_1$ to $L_2$, and $(L_2-L_1)/L \geqq 0.20$ is satisfied.

DETAILED DESCRIPTION OF THE INVENTION

The emulsion according to the invention comprises silver halide grains grown from seed crystals. And as reaction elements to be supplied, there may be used an aqueous solution of silver salt, an aqueous solution of halide salt and silver halide fine grains.

In forming silver halide phases on the surfaces of seed crystals by growing silver halide grains from seed crystals with the addition of reaction elements, silver halide phases, which are formed before 30% of the addition amount of silver is supplied as a reaction element, are formed within a range of 0.1 to 2.0 μm in terms of the intergrain distance of individual silver halide grains contained in the reaction liquor.

The term "intergrain distance of individual silver halide grains" used here means the distance between the centers of adjacent grains when all the silver halide grains contained in a reaction liquor are each dispersed at the same intervals. In other words, supposed spheres having a radius r from the center of the grains are assumed to occupy the entire dispersion solution in a state of face-centered cubic lattice. Accordingly, the distance between grains can be obtained from the following equation:

$$\text{Distance between the grains} = 2 \times \sqrt[3]{0.74 \times V/N \times 3/(4\pi)}$$

wherein V represents an amount of the dispersion solution; N represents the number of grains present in the dispersion solution; and 0.74 represents a volume occupied ratio of face-centered cubic lattice. The intergrain distance of individual silver halide grains is maintained preferably within the range of 0.1 to 1.5 μm.

As the effect of the invention, these requirements bring about the following advantages: (1) desired high iodide content cores can be formed by growing silver halide grains from seed crystals, with the grains kept within the foregoing intergrain distance before 30% of the addition amount of silver is supplied, and (2) aggregation of silver halide grains can be prevented during emulsion preparation and, as a result, the fogging property and graininess are improved.

The term "aggregation of silver halide grains" used here indicates both the formation of coarse grains due to coalescence of two or more silver halide grains into one which is followed by the growth of the coalesced grain as one grain, and the formation of clusters due to coalescence of silver halide grains with their shapes and sizes unchanged.

To study the influence exerted by aggregation of silver halide grains, the present inventors determined the rate of aggregation (number of aggregated silver halide grains ×100/1000) (%) by counting the number of aggregated grains contained in 1000 grains with a scanning electron microscope made by Nippon Denshi Co. As a result, it was found that fog density became higher and graininess was deteriorated as the rate of aggregation of emulsion grains became heavier.

In the silver halide emulsion according to the invention, the rate of aggregation is preferably not more than 10%, more preferably not more than 5%.

The term "addition amount of silver" used in the invention means the amount of silver salts necessary to grow silver halide grains from seed crystals to a desired size.

The silver halide emulsion according to the invention is prepared in the presence of a dispersion medium, namely, in an aqueous solution containing a dispersion medium. An aqueous solution containing a dispersion medium means an aqueous solution in which a protective colloid is formed by a hydrophilic-colloid--forming substance (a substance functions as binder, etc.) such as gelatin or the like. Preferred examples thereof include aqueous solutions containing a protective gelatin in colloidal state.

In the embodiment of the invention, the gelatin used as the above protective colloid may be any of lime-processed ones and acid-processed ones.

Manufacture of these gelatins is described in detail in A. Veis, "The Macromolecular Chemistry of Gelatin", Academic Press (1964).

Hydrophilic colloids usable as protective colloids include, in addition to gelatins, gelatin derivatives; grafted polymers of gelatin with other polymers; proteins such as albumin and casein; cellulose derivatives such as hydroxyethyl cellulose, carboxymethyl cellulose, cellulose sulfate; sodium alginate; sugar derivatives such as starch derivatives; and various hydrophilic synthetic polymers including homopolymers and copolymers such as polyvinyl alcohol, partial acetals of polyvinyl alcohol, poly-N-vinylpyrrolidone, polyacrylic acid, polymethacrylic acid, polyacrylamide, polyvinylimidazole and polyvinylpyrazole.

When gelatin is used, preferred is one having a jelly strength of 200 or more according to the PAGI method.

In the invention, the center of a silver halide grain is determined by the same method as that reported by Inoue et al. on pages 46–48 of The Collection of Lectures at the Annual Meeting of the Photographic Society of Japan. That is, after dispersing a silver halide grain in a methacrylate resin, the resin is cured and sliced into very thin specimens with a microtome. Among the microtomed-sections of the grain, the largest one and ones whose sectional areas are 90% or more of that of the largest one are selected. The center of a silver halide grain is given by the center of a circumcircle drawn for each section so as to give the smallest circle.

In the invention, distance L from the center to the surface is defined as the distance from the center of the foregoing circle to the intersecting point of the periphery of a grain and a straight line drawn outward from the center of the circle.

Further, the points at which the silver iodide content become maximum and minimum as well as distances $L_1$ and $L_2$ from the center can be determined by measuring, using the XMA method, silver iodide contents and positions on the foregoing straight line drawn from the center to the periphery.

When the relational expression of the invention is valid for any of L, $L_1$ and $L_2$ each defined on a straight line drawn in an arbitrary direction from the center of the foregoing circumcircle, those silver halide grains which meet this are regarded to be the silver halide grains of the invention. When a plurality of specific points are found for each of the maximum silver iodide content and the minimum silver iodide content in the measurement of internal structure of the silver halide grain, the specific point farthest from the center is selected for the maximum silver iodide content, and the specific point nearest from the center is selected for the minimum silver iodide content.

In the silver halide grain of the invention, the difference of silver iodide content between the point at which the silver iodide content becomes maximum ($I_{max}$) and the point at which the silver iodide content becomes minimum ($I_{min}$), namely $I_{max}-I_{min}$, is preferably within the range of 5 to 40 mol %, more preferably within the range of 15 to 35 mol %.

The silver halide grain of the invention comprises silver iodobromide having an average silver iodide content of preferably 1 to 20 mol %, more preferably 3 to 15 mol %.

In addition, silver chloride may be contained within the range not harmful to the effect of the invention.

In the silver halide grain according to the invention, the silver halide grain internal structure in which the silver iodide content decreases substantially monotonously is a structure wherein the silver iodide content decreases (1) linearly, or (2) continuously without having maximum or minimum, from specific point $L_1$ at which the silver iodide content is maximum to specific point $L_2$ at which the silver iodide content is minimum.

In order to bring out the effect of the invention much more, the foregoing structure (1) is preferred. In the silver halide grain according to the invention, the silver iodide content in the area inside of specific point $L_1$ may monotonously decrease toward the center, or may be uniform.

While specific point $L_1$ at which the silver iodide content becomes maximum is located in the range up to 0.67 L from the grain center, it is preferably located in the range up to 0.62 L. Further, in the range from specific point $L_2$ at which the silver iodide content becomes minimum to the grain surface, the silver iodide content may have any value within the range from the minimum content to the maximum content.

In addition, while specific $L_2$ at which the silver iodide content becomes minimum is located outside of 0.58 L, it is preferably located outside of 0.80 L.

The silver iodide content of each silver halide grain and the average silver iodide content can be determined by the electron probe microanalyzer method (the EPMA method).

This method makes possible to carry out an elemental analysis of a very small portion by the steps of preparing a sample in which emulsion grains are dispersed thoroughly without contacting one another and subjecting the sample to X-ray analysis utilizing the electron ray excitation due to irradiation of electron beams. The silver halide composition of each grain can be determined by measuring the characteristic X-ray intensities of silver and iodine emitted from each grain. The average silver iodide content can be obtained by measuring silver iodide contents at least for 50 grains by the EPMA method and averaging the measured values.

Preferably, the emulsion of the invention comprises grains among which the silver-iodide content is uniform.

The relative standard deviation thereof (coefficient of variation), which is obtained by measuring the distribution of silver iodide content among grains by the EPMA method, is preferably not more than 35%, especially not more than 20%.

The silver iodide content in the surface layer of a silver halide grain can be determined by X-ray photoelectron spectrometry. In carrying out X-ray photoelectron spectrometry, an emulsion is pretreated before measurement: first, 10 ml of 0.01 wt % aqueous pronase solution is added to about 1 ml of sample, followed by stirring for 1 hour at 40° C. to decompose gelatin. After depositing emulsion grains through centrifugation and removing the supernatant liquid, 10 ml of the aqueous solution of pronase is added thereto to decompose the gelatin again under the above conditions. After subjecting the sample to centrifugation and removing the supernatant liquid again, 10 ml of deionized water is added, and the emulsion grains are redispersed in the water and centrifuged, followed by removal of the supernatant liquid. After repeating this washing procedure three times, the emulsion grains are redispersed in ethanol (the procedure up to here is carried out in a darkroom). Then, the dispersion is thinly coated on a mirror-polished silicone wafer, in a semi-dark room, to obtain a specimen. The specimen obtained is subjected to measurement by X-ray. photoelectron spectrometry within 24 hours.

In this X-ray photoelectron spectrometry, an ESCA/SAM 560 made by PHI Co. is used as measuring equipment. The specimen is fixed on a holder inclined at 60°, subjected to a 10-minute evacuation with a turbomolecular pump in a pre-evacuation chamber, and introduced into a measuring chamber. Within 1 minute after introducing the sample, irradiation of an exciting X-ray (Mg-K $\alpha$ ray) is started, and measurement is immediately begun under the conditions of X-ray radiation source voltage: 15 kV, X-ray radiation source current: 40 mA and pass energy: 50 eV.

To determine the surface silver halide composition, Ag 3d, Br 3d and I 3d3/2 electrons are detected. In detecting the Ag 3d electron, measurement is made within the bond energy range of 381 eV to 361 eV, at scanning steps of 0.2 eV, by making one 100-msec scanning for each scanning step. In detecting the Br 3d electron, measurement is made within the overall energy range of 79 eV to 59 eV, at scanning steps of 0.2 eV, by repeating a 100-msec scanning five times for each scanning step. In detecting the I 3d3/2 electron, measurement is made within the overall energy range of 644 eV to 624 eV, at scanning steps of 0.2 eV, by repeating a 100-msec scanning forty times for each scanning step. The above procedure is repeated two times, and the measured-values are integrated to obtain data to be recorded.

The composition ratio is calculated by use of the integrated intensity of each peak. The integrated intensity of the Ag 3d peak is determined in cps.eV by taking, as base line, a straight line connecting the intensity of energy given by adding 4 eV to the overall energy at which the Ag 3d3/2 peak shows the maximum value and the intensity of energy given by adding 4 eV to the bond energy at which the Ag 3d5/2 peak shows the maximum value. The integrated intensity of the Br 3d peak is determined in cps.eV by taking, as base line, a straight line connecting the intensity of energy given by adding 4 eV to the overall energy at which the Br 3d5/2 peak shows the maximum value and the intensity of energy given by subtracting 3 eV from the overall energy at which the Br 3d5/2 peak shows the maximum value. And the integrated intensity of the I 3d3/2 peak is determined in cps.eV by taking, as base line, a straight line connecting the intensity of energy given by adding 4 eV to the overall energy at which the I 3d3/2 peak shows the maximum value and the intensity of energy given by subtracting 4 eV from the overall energy at which the I 3d3/2 peak shows the maximum value.

In making a calculation of the composition ratio from the integrated intensities of the respective peaks, the relative sensitivity coefficient method is used, and the composition can be obtained in atomic percents by taking 5.10, 0.81 and 4,592, respectively, as relative sensitivity coefficients of Ag 3d, Br 3d and I 3d3/2.

Further, the molar percent of iodine is given by dividing the atomic percent of iodine by the sum of the atomic percent of bromine and the atomic percent of iodine.

In the invention, a silver halide emulsion preferably contains silver halide twin crystal grains having twin planes of even number. It is further preferable that the silver halide grains of the invention are tabular grains having an aspect ratio of 1.0 to 5.0 and a ratio of an average thickness (T) of the grains to an average shortest spacing (I) between twin planes of indivisual grains of 5 or more.

Herein the shortest spacing between twin planes refers to the distance between two twin planes in the case of a grain having two twin planes. In the case of a grain having four or more twin planes, it refers to the shortest spacing among distances between two twin planes adjacent to each other.

The twin planes can be observed using a transmission electron microscope. For example, an emulsion containing tabular grains is coated on a support to prepare a sample so as for the grains to be oriented substantially in parallel on the support, and thereafter the sample is cut with a diamond knife to give thin section in a thickness of about 0.1 μm. Observation of the resulting sections using a transmission electron microscope can confirm the presence of the twin planes.

The average shortest spacing (I) between twin planes of the invention is preferably within a range of 0.01 to 0.1 μm, more preferably 0.013 to 0.05 μm.

Thickness of a grain is a distance between parallel surface of the grain. Silver halide grains used in the present invention have preferably an average thickness (T) of 0.05 to 1.5 μm, more preferably 0.2 to 1.0 μm.

In the present invention, silver halide grains having a ratio (T/I) of 5 or more account for more than 50% of total grains, based on number of the grains, more preferably more than 70%. It is further preferable that silver halide grains having a ratio (T/I) of 10 or more account for more than 50% in number, more preferably more than 70%.

In manufacturing the silver halide emulsion of the invention, the control of pAg is very important during the growth of crystals. The pAg during the growth of crystals is preferably 6 to 12.

During the formation of silver halide, the pAg may be kept constant, or may be changed stepwise or continuously. When changed, the pAg is preferably raised as the formation of silver halide grains proceeds.

In the manufacture of the silver halide emulsion according to the invention, stirring conditions during the manufacture are very important. In a preferable embodiment of the invention, stirring is performed at stirring speeds of 200 to 1000 rpm by use of the stirring equipment disclosed in Japanese Pat. O.P.I. Pub. No. 160128/1987, this equipment supplies an aqueous solution of silver salt and an aqueous solution of halide by the double-jet method.

The form of silver halide grains contained in the emulsion of the invention may be any of regular crystals including cubes, octahedrons, tetradecahedrons and twin crystals including tabular crystals.

The silver halide emulsion of the invention may be either a polydispersed emulsion having a wide grain size distribution or a monodispersed emulsion having a narrow grain size distribution, and each emulsion may be a single emulsion or a mixture of these emulsions. But, when a light-sensitive material is prepared by use of the emulsion of the invention, a monodispersed emulsion is preferred.

In such a monodispersed silver halide emulsion, the weight of silver halide grains whose grain sizes fall within ±20% of average grain size r is preferably 60 wt % or more, more preferably 70 wt % or more and most preferably 80 wt % or more of the total weight of silver halide grains.

In the invention, average grain size r is defined as grain size ri at which the product of frequency ni of grains having grain size ri and $ri^3$, namely $ni \times ri^3$, becomes largest (three significant figures, the last figure is rounded to the nearest whole number).

The term "grain size" used here means the diameter of a grain for a spherical silver halide grain, or the diameter of a disk having an area equal to the projected area of a grain for a non-spherical grain.

The grain size can be measured, for example, by photographing a grain on an electron microscope at magnifications of 10,000 to 50,000 and measuring the grain's diameter or the grain's projected area on the print (the number of grains to be measured is at least 1000 selected at random).

Highly monodispersed emulsions are particularly advantageous in the embodiment of the invention. When the extent of grain size distribution is defined by $$\frac{\text{Standard Deviation}}{\text{Average Grain Size}} \times 100 = \text{Extent of Distribution (\%)},$$

the extent of distribution (or coefficient of variation) of such emulsions is preferably not more than 20% and more preferably not more than 15%.

The average grain size and the standard deviation used here are determined from the foregoing grain size ri.

These monodispersed emulsions can be prepared by adding, to an aqueous solution of gelatin containing seed grains, two or more reaction elements arbitrarily selected from a solution of water-soluble silver salt, a solution of water-soluble halide and silver halide fine grains, with the pAg and pH controlled appropriately. In deciding the addition speed, the description in Japanese Pat. O.P.I. Pub. Nos. 48521/1979 and 49938/1983 can be referred to.

Further, the method disclosed in Japanese Pat. O.P.I. Pub. No. 122935/1985, which grows grains in the presence of tetraazaindene, can be utilized for the preparation of much highly monodispersed emulsions.

During the preparation of the silver halide emulsion of the invention, there may be present conventional silver halide solvents such as ammonia, thioether and thiourea, or these silver halide solvents need not be used.

In the process to form grains and/or in the process to grow grains, there may be added metal ions by use of at least one compound selected from cadmium salts, zinc salts, lead salts, thallium salts and iridium salts (including complex salts) for the purpose of incorporating these metal elements in the inner portion of grains and/or on the surface of grains. Further, there may be provided reduction-sensitized specks in the inner portion of grains and/or on the surface of grains by subjecting these grains to a reducing atmosphere.

The silver halide grains may be those which form latent images mainly on the surface or those which form latent images mainly in the inner portion. And the size of these grains is preferably 0.05 to 5.0 μm, more preferably 0.1 to 3.0 μm.

The silver halide emulsion of the invention may be one from which useless soluble salts are removed after the growth of silver halide grains, or one which holds such salts unremoved.

Desalting may be made anytime during the growth of silver halide grains as described in Japanese Pat. O.P.I. Pub. No. 138538/1985. Removal of salts can be carried out according to the methods described in Research Disclosure No. 17643, Sec. II. That is, in order to remove soluble salts from an emulsion after forming precipitates or after physical ripening, there may be used the noodle washing method which performs desalting by gelation of gelatin, or the flocculation method which utilizes inorganic salts, anionic surfactants, anionic polymers (polystyrenesulfonic acid, etc.) or gelatin derivatives (acylated gelatin, carbamoylated gelatin, etc.).

The silver halide emulsion of the invention can be chemically sensitized by the usual method; that is, there can be employed, singly or in combination, sulfur sensitization, selenium sensitization, reduction sensitization, and noble metal sensitization with gold or other noble metals.

The silver halide emulsion of the invention may be optically sensitized to a desired wavelength range by use of dyes known as sensitizing dyes in the art. Sensitizing dyes may be used singly or in combination of two or more types. In addition, there may be used, jointly with sensitizing dyes, supersensitizers which comprise dyes having no sensitizing function by themselves, or compounds absorbing substantially no visible light, but having capabilities of raising the sensitizing function of sensitizing dyes.

The silver halide emulsion of-the invention may contain antifoggants and stabilizers. As a binder for the emulsion, gelatin is advantageously used. Emulsion layers and other hydrophilic colloidal layers may be hardened and, further, may contain plasticizers and latex of water insoluble or sparingly soluble synthetic polymers.

In emulsion layers of a color light-sensitive material, couplers are employed. Further, there may be contained competitive couplers having color correction capabilities as well as compounds capable of releasing, upon coupling with an oxidation product of developing agent, photographically useful fragments such as developing accelerators, developers, silver halide solvents, toning agents, hardeners, foggants, antifoggants, chemical sensitizers, optical sensitizers or desensitizers.

In the light-sensitive material, auxiliary layers such as a filter layer, antihalation layer and anti-irradiation layer may be provided. These layers and/or emulsion layers may contain dyes which are washed out or bleached while the light-sensitive material is processed.

The light-sensitive material may contain matting agents, lubricants, image stabilizers, formalin scavengers, UV absorbents, optical whitening agents, surfactants, developing accelerators and developing retarders. As supports, polyethylene laminated paper, polyethylene terephthalate film, baryta paper and cellulose triacetate film can be used.

EXAMPLES

The invention is hereunder described in detail with examples, but the scope of the invention is not limited to these examples.

Example 1

Preparation of Twin Seed Emulsion T-1

Seed emulsion T-1 comprising crystal grains having two parallel twin planes was prepared as follows:

| | |
|---|---|
| Solution A | |
| Ossein gelatin | 80.0 g |
| Potassium bromide | 47.4 g |
| 10% methanol solution of sodium polyisopropylene-polyethyleneoxy-disuccinate | 0.48 ml |
| Water was added to | 8000.0 ml |
| Solution B | |
| Siler nitrate | 1200.0 g |
| Water was added to | 1600.0 ml |
| Solution C | |
| Ossein gelatin | 32.2 g |
| Potassium bromide | 790.0 g |
| Potassium iodide | 70.34 g |
| Water was added to | 1600.0 ml |
| Solution D | |
| Aqueous ammonia | 470.0 ml |

While vigorously stirring solution A at 40° C., solutions B and C were added thereto in 7.7 minutes by the double-jet method to form crystalline nuclei. During the addition, the pBr was kept at 1.60.

Then, the temperature was lowered to 20° C. in 30 minutes. Further, solution D was added to the reaction system in 1 minute, followed by a 5-minute ripening with the KBr concentration at 0.03 mol/l and the ammonia concentration at 0.66 mol/l.

After completing the ripening, the pH was adjusted to 6.0 and desalting was carried out in the usual manner. Electron microscopic observations of the resultant seed grains proved that these grains were hexagonal tabular grains having two twin planes parallel to each other.

The average grain size of the seed grains was 0.21 μm, and grains having two parallel twin planes amounted to 75% of the total number of grains.

Preparation of Emulsion EM-1 of the Invention

Emulsion EM-1 of the invention, an emulsion comprising monodispersed octahedral twin crystal grains, was prepared using the following seven solutions:

| | |
|---|---|
| Solution A | |
| Ossein gelatin | 61.0 g |
| Deionized water | 1963.0 ml |
| 10% methanol solution of sodium polyisopropylene-polyethyleneoxy-disuccinate | 2.5 ml |
| Seed emulsion T-1 | 0.345 mol |
| 28 wt % Aqueous ammonia | 308.0 ml |
| 56 wt % Aqueous acetic acid solution | 358.0 ml |
| Deionized water was added to | 3500.0 ml |

Solution B 3.5N Aqueous solution of ammoniacal silver nitrate (pH was adjusted to 9.0 with ammonium nitrate)

Solution C 3.5N Aqueous solution of potassium bromide

Solution D 3 wt % Gelatin and 1.40 mol of silver iodide fine grain emulsion (average grain size: 0.05 μm) prepared as follows:

Preparation of Silver Iodide Fine Grain Emulsion

To 5000 ml of 6.0 wt % gelatin solution containing 0.06 mol of potassium iodide were added in 10 minutes 2000 ml each of an aqueous solution containing 7.06 mol of silver nitrate and an aqueous solution containing 7.06 mol of potassium iodide. During the formation of fine grains, the pH was adjusted to 2.0 with nitric acid and the temperature was kept at 40° C.

After the formation fine grains, the pH was adjusted to 6.0 with an aqueous solution.of sodium carbonate.

Solution E 3.68 mol of silver iodobromide fine grain emulsion (average grain size: 0.04 μm) containing 2 mol % of silver iodide, which was prepared in a manner similar to the silver iodide fine grain emulsion of solution D (The temperature was controlled at 30° while fine grains were formed.)

Solution F 1.75N Aqueous potassium bromide solution

Solution G 56 wt % Aqueous acetic acid solution

While stirring solution A vigorously at 70° C. in a reaction vessel, solutions B, C and D were added thereto in 128 minutes by the double-jet method and, then, solution E was added in 7 minutes at a constant flow rate, so that the seed crystals were grown up to 0.806 μm.

The addition rates of Solutions B and C were changed as a function of time so as to be balanced with the critical growth rate; that is, the addition rates were properly controlled to prevent formation of small grains other than seed grains being grown and polydispersing due to the Ostwald ripening.

Solution D, or silver iodide fine grain emulsion, was supplied while changing its addition rate ratio (molar ratio ×100) to the aqueous solution of ammoniacal silver nitrate (Solution B) in relation to the grain size (the addition time) as shown in the following Table 1, so that emulsion EM-1, a silver iodobromide emulsion having a continuous silver iodide composition of the invention, was obtained.

During the growth of crystal grains, the pAg and pH were controlled by use of solutions F and G as shown in Table 1. Measurements of pAg and pH were made by the usual method using a silver sulfide electrode and a glass electrode.

After the growth of grains, desalting was carried out according to the method described in Japanese Pat. Appl. No. 41314/1991, and the grains were redispersed by adding gelatin. Then, the emulsion obtained was adjusted to pH 5.80 and pAg 8.06 at 40° C.

From a scanning electron microphotograph of the resultant emulsion grains, the emulsion was proved to comprise monodispersed octahedral twin grains having an average grain size of 0.806 μm and an extent of distribution of 12.0%.

TABLE 1

| Addition Time (min) | Grain Size (μm) | Addition rate ratio of Solution D | | pH | pAg |
|---|---|---|---|---|---|
| 0.0 | 0.217 | 6.0 | | 7.2 | 7.8 |
| 26.20 | 0.345 | 20.1 | | 7.2 | 7.8 |
| 40.86 | 0.394 | 29.5 | | 7.2 | 7.8 |
| 41.57 | 0.397 | 30.0 | | 7.2 | 7.8 |
| 54.11 | 0.434 | 30.0 | | 7.2 | 7.8 |
| 64.89 | 0.466 | 30.0 | | 7.2 | 7.8 |
| 68.00 | 0.480 | 27.9 | | 7.2 | 7.8 |
| 79.00 | 0.520 | 21.9 | | 7.2 | 7.8 |
| 84.50 | 0.540 | 18.9 | | 7.2 | 7.8 |
| 90.00 | 0.560 | 15.9 | * | 7.2 | 7.8 |
| 95.50 | 0.580 | 12.9 | | 7.2 | 7.8 |
| 101.00 | 0.600 | 9.9 | | 7.2 | 7.8 |
| 106.50 | 0.620 | 6.9 | | 7.2 | 7.8 |
| 112.00 | 0.620 | 6.9 | | 6.5 | 9.7 |
| 117.50 | 0.640 | 3.9 | | 6.5 | 9.7 |
| 123.00 | 0.666 | 0.0 | | 6.5 | 9.7 |

TABLE 1-continued

| Addition Time (min) | Grain Size (μm) | Addition rate ratio of Solution D | pH | pAg |
|---|---|---|---|---|
| 128.00 | 0.745 | 0.0 | 6.5 | 9.7 |

*In this portion the iodide composition was continuously changed.

Emulsion EM-2 of the invention was prepared in the same manner as emulsion EM-1, except that solution A was made up to 50000.0 ml by increasing the volume of the deionized water used in solution A.

Emulsion EM-3 of the invention was prepared in the same manner as emulsion EM-1, except that the addition rate ratio of solution D, or silver iodide fine grain emulsion, to the aqueous solution of ammoniacal silver nitrate (solution B) was changed.

Preparation of Emulsion EM-4 for Comparison

Emulsion EM-4 for comparison was prepared in the same manner as emulsion Em-1, except that the addition rate ratio (molar ratio ×100) of solution D, or silver iodide fine grain emulsion, to the aqueous solution of ammoniacal silver nitrate (solution B) was changed in relation to the grain size (the addition time) as shown in the following Table 2.

TABLE 2

| Addition Time (min) | Grain Size (μm) | Addition rate ratio of Solution D | pH | pAg |
|---|---|---|---|---|
| 0.0 | 0.217 | 6.0 | 7.2 | 7.8 |
| 26.20 | 0.345 | 20.1 | 7.2 | 7.8 |
| 40.86 | 0.394 | 29.5 | 7.2 | 7.8 |
| 41.57 | 0.397 | 30.0 | 7.2 | 7.8 |
| 54.11 | 0.434 | 30.0 | 7.2 | 7.8 |
| 64.89 | 0.466 | 30.0 | 7.2 | 7.8 |
| 64.89 | 0.466 | 20.0 | 7.2 | 7.8 |
| 90.00 | 0.558 | 20.0 | 7.2 | 7.8 |
| 90.00 | 0.558 | 12.1 | 7.2 | 7.8 |
| 107.50 | 0.620 | 12.1 | 6.5 | 9.7 |
| 123.00 | 0.666 | 12.1 | 6.5 | 9.7 |
| 123.00 | 0.666 | 0.0 | 6.5 | 9.7 |
| 128.00 | 0.745 | 0.0 | 6.5 | 8.7 |

Emulsion EM-5 for comparison was prepared in the same manner as emulsion EM-1, except that solution A was made up to 20000.0 ml by increasing the volume of the deionized water used in solution A.

Emulsion EM-6 for comparison was prepared in the same manner as emulsion EM-1, except that addition rate ratio of solution D, or silver iodide fine grain emulsion, to the aqueous solution of ammoniacal silver nitrate (solution B) was changed and a pAg value was mantained to be 11.0.

Emulsion EM-7 for comparison was prepared in the same manner as emulsion EM-4, except that solution A was made up to 20000.0 ml by increasing the volume of the deionized water used in solution A and a pAg value was maintained to be 11.0.

Emulsions EM-1 to EM-7 prepared as above were photographed with a scanning electron microscope made by Nippon Denshi Co., and the rate of aggregation was determined for 1000 each of silver halide grains.

The position at which the iodide content becomes maximum and minimum within the grain was determined, using X-ray microanalyzer (XMA method) as aforementioned, for each of grains of emulsions EM-1 to EM-7.

Table 3 shows preparation conditions and examination results of emulsions EM-1 to EM-7.

TABLE 3

| Emulsion | $L_1$ [μm] | $L_2$ [μm] | $\frac{L_2 - L_1}{L}$ | Intergrain Distance during Grain Growth: Immediately after the Start of Addition (μm) | Intergrain Distance during Grain Growth: When Addition Reaches 30% of Silver Amount (μm) | Extent of Grain Size Distribution (%) | Aggregation Rate of Silver Halide Grains (%) | Average aspect ratio | T/I |
|---|---|---|---|---|---|---|---|---|---|
| EM-1 (inv.) | 0.58L | 0.83L | 0.25 | 0.99 | 1.28 | 12.0 | 2.1 | 1.43 | 30.5 |
| EM-2 (inv.) | 0.58L | 0.83L | 0.25 | 1.41 | 1.83 | 13.5 | 6.2 | 1.55 | 29.2 |
| EM-3 (inv.) | 0.58L | 0.79L | 0.21 | 0.99 | 1.78 | 13.2 | 2.2 | 1.90 | 23.0 |
| EM-4 (comp.) | Having no continuous change in iodide composition | | | 0.99 | 1.28 | 21.8 | 5.9 | 1.70 | 27.2 |
| EM-5 (comp.) | 0.58L | 0.83L | 0.25 | 5.66 | 7.31 | 23.9 | 26.8 | 1.61 | 28.1 |
| EM-6 (comp.) | 0.71L | 0.75L | 0.04 | 0.99 | 1.28 | 21.1 | 4.1 | 8.5 | 3.8 |
| EM-7 (comp.) | Having no continuous change in iodide composition | | | 5.66 | 7.31 | 26.2 | 27.4 | 10.8 | 4.0 |

As is shown in Table 3, emulsions EM-1 to EM-3 of the invention were markedly improved in anti-aggregation property. Among the emulsions for comparison, emulsions EM-4 and EM-6, though these had no continuous change in iodide composition, exhibited aggregation percentages as low as those of the emulsions of the invention. This is attributed to the fact that these were prepared with the intergrain distance kept within the range specified by the invention.

On the other hand, emulsions EM-5 and EM-7 prepared using wide intergrain distances were greatly deteriorated in anti-aggregation property.

Example 2 (Preparation of Light-sensitive Material)

Emulsions EM-1 to EM-7 were optimally subjected to gold-sulfur sensitization. Using these emulsions, layers of the following compositions were formed in order on a triacetyl cellulose film support to prepare a multilayered color light-sensitive material.

In the description to follow, addition amounts to the light-sensitive material are in grams per square meter unless otherwise specified. Amounts of silver halide and colloidal silver are given in amounts of silver present, amounts of sensitizing dyes are given in moles per mole of silver halide.

The multilayered color photographic light-sensitive material, sample No. 1, (emulsion EM-1 of invention was used) comprised the following layers:

| | |
|---|---|
| 1st layer: antihalation layer | |
| Black colloidal silver | 0.16 |
| UV absorbent UV-1 | 0.30 |
| Gelatin | 1.70 |
| 2nd layer: intermediate layer (IL-1) | |
| Gelatin | 0.80 |
| 3rd layer: low-speed red-sensitive layer (R-L) | |
| Silver iodobromide emulsion (average grain size: 0.30 μm) | 0.40 |
| Sensitizing dye S-1 | $1.2 \times 10^{-4}$ |
| Sensitizing dye S-2 | $0.2 \times 10^{-4}$ |
| Sensitizing dye S-3 | $2.0 \times 10^{-4}$ |
| Sensitizing dye S-4 | $1.2 \times 10^{-4}$ |
| Cyan coupler C-1 | 0.33 |
| Colored cyan coupler CC-1 | 0.05 |
| High boiling solvent Oil-1 | 0.30 |
| Gelatin | 0.55 |

-continued

| | |
|---|---|
| 4th layer: medium-speed red-sensitive layer (R-M) | |
| Silver iodobromide emulsion (average grain size: 0.4 μm) | 0.48 |
| Sensitizing dye S-1 | $1.5 \times 10^{-4}$ |
| Sensitizing dye S-2 | $0.2 \times 10^{-4}$ |
| Sensitizing dye S-3 | $2.5 \times 10^{-4}$ |
| Sensitizing dye S-4 | $1.5 \times 10^{-4}$ |
| Cyan coupler C-1 | 0.30 |
| Colored cyan coupler CC-1 | 0.05 |
| High boiling solvent Oil-1 | 0.40 |
| Gelatin | 0.60 |
| 5th layer: high-speed red-sensitive layer (R-H) | |
| Silver iodobromide emulsion (average grain size: 0.55 μm) | 0.66 |
| Sensitizing dye S-1 | $1.0 \times 10^{-4}$ |
| Sensitizing dye S-2 | $0.2 \times 10^{-4}$ |
| Sensitizing dye S-3 | $1.7 \times 10^{-4}$ |
| Sensitizing dye S-4 | $1.0 \times 10^{-4}$ |
| Cyan coupler C-2 | 0.10 |
| Colored cyan coupler CC-1 | 0.01 |
| DIR compound D-1 | 0.02 |
| High boiling solvent Oil-1 | 0.15 |
| Gelatin | 0.53 |
| 6th layer: intermediate layer (IL-2) | |
| Gelatin | 0.80 |
| 7th layer: low-speed green-sensitive layer (G-L) | |
| Silver iodobromide emulsion (average grain size: 0.40 μm) | 0.60 |
| Siler iodobromide emulsion (average grain size: 0.30 μm) | 0.40 |
| Sensitizing dye S-1 | $0.6 \times 10^{-4}$ |
| Sensitizing dye S 5 | $5.1 \times 10^{-4}$ |
| Magenta coupler M-1 | 0.55 |
| Colored magenta coupler CM-1 | 0.17 |
| DIR compound D-2 | 0.03 |
| High boiling solvent Oil-2 | 0.70 |
| Gelatin | 1.56 |
| 8th layer: high-speed green-sensitive layer (G-H) | |
| Silver iodobromide emulsion (emulsion EM-1 of the invention) | 0.60 |
| Sensitizing dye S-6 | $1.5 \times 10^{-4}$ |
| Sensitizing dye S-7 | $1.5 \times 10^{-4}$ |
| Sensitizing dye S-8 | $1.5 \times 10^{-4}$ |
| Magenta coupler M-1 | 0.06 |
| Magenta coupler M-2 | 0.02 |
| Colored magenta coupler CM-2 | 0.02 |
| DIR compound D-3 | 0.002 |
| High boiling solvent Oil-2 | 0.15 |
| Gelatin | 0.45 |
| 9th layer: yellow filter layer (YC) | |
| Yellow colloidal silver | 0.12 |
| HS-1 | 0.20 |
| HS-2 | 0.14 |
| High boiling solvent Oil-2 | 0.18 |

-continued

| | |
|---|---|
| Gelatin | 0.80 |
| 10th layer: low-speed blee-sensitive layer (B-L) | |
| Silver iodobromide emulsion (average grain size: 0.4 μm) | 0.18 |
| Silver iodobromide emulsion (average grain size: 0.3 μm) | 0.35 |
| Sensitizing dye S-9 | $5.1 \times 10^{-4}$ |
| Sensitizing dye S-10 | $2.0 \times 10^{-4}$ |
| Yellow coupler Y-1 | 0.58 |
| Yellow coupler Y-2 | 0.30 |
| High boiling solvent Oil-2 | 0.15 |
| Gelatin | 1.20 |
| 11th layer: high-speed blue-sensitive layer (B-H) | |
| Silver iodobromide emulsion (average grain size: 0.65 μm) | 0.45 |
| Sensitizing dye S-9 | $2.8 \times 10^{-4}$ |
| Sensitizing dye S-10 | $1.0 \times 10^{-4}$ |
| Yellow coupler Y-1 | 0.10 |
| High boiling solvent Oil-2 | 0.04 |
| Gelatin | 0.50 |
| 12th layer: 1st protective layer (Pro-1) | |

-continued

| | |
|---|---|
| Silver iodobromide emulsion (average grain size: 0.07 μm) | 0.30 |
| UV absorbent UV-1 | 0.07 |
| UV absorbent UV-2 | 0.10 |
| High boiling solvent Oil-2 | 0.07 |
| High boiling solvent Oil-3 | 0.07 |
| HS-1 | 0.25 |
| Gelatin | 0.80 |
| 13th layer: 2nd protective layer (Pro-2) | |
| Alkali-soluble matting agent (average particle size: 2 μm) | 0.13 |
| Polymethyl methacrylate (average particle size: 3 μm) | 0.02 |
| Gelatin | 0.50 |

Besides the above compositions, coating aid Su-1, dispersing agent Su-2, hardeners H-1 and H-2, dyes AI-1 and AI-2 were properly added.

Chemical structures of the compounds used in the above light-sensitive material are as follows:

C-1

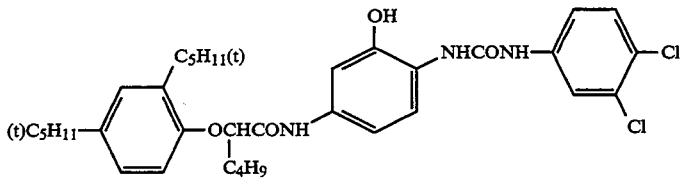

C-2

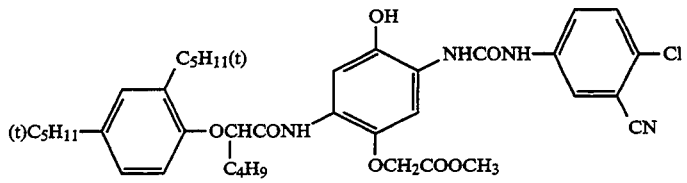

M-1

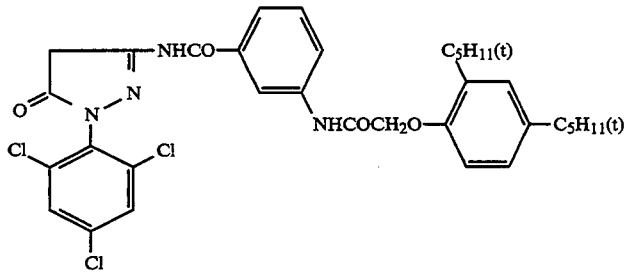

M-2

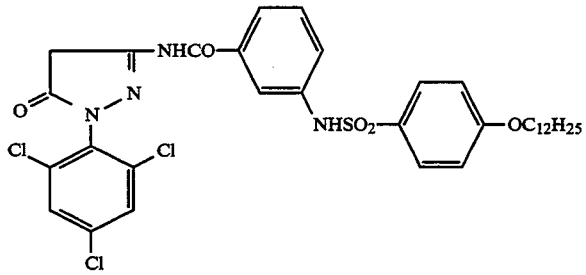

-continued
Y-1
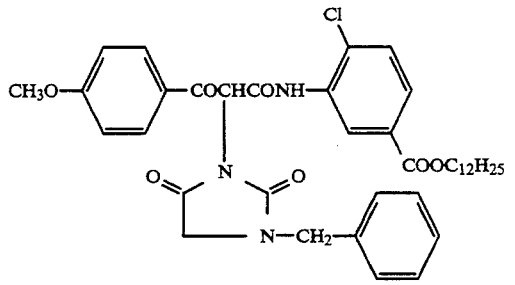
Y-2
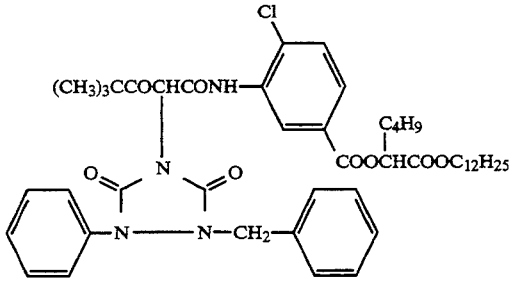
CC-1
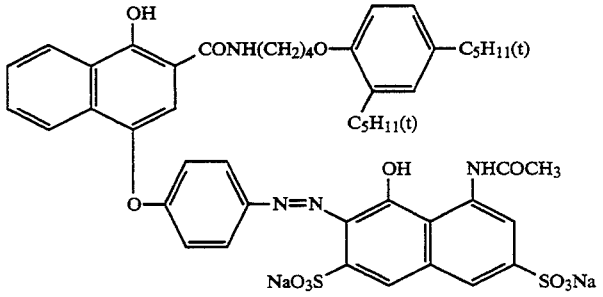
CM-1
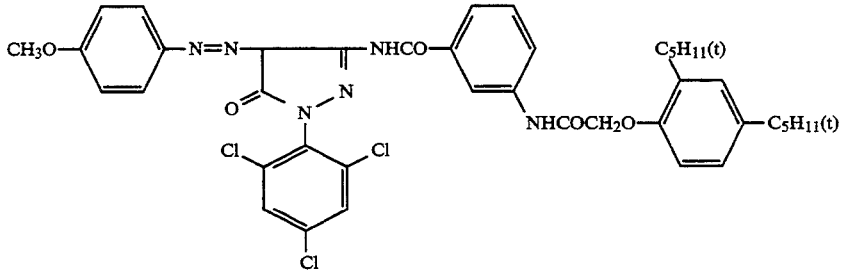
CM-2
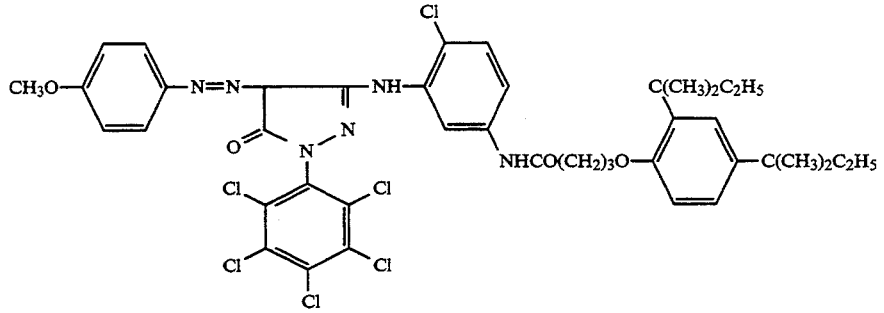

-continued
D-1
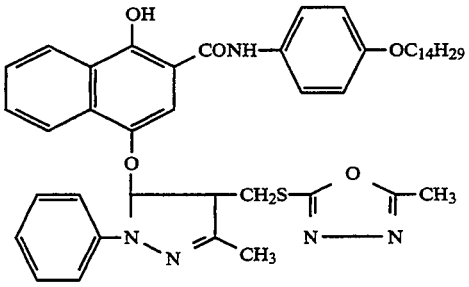
D-2
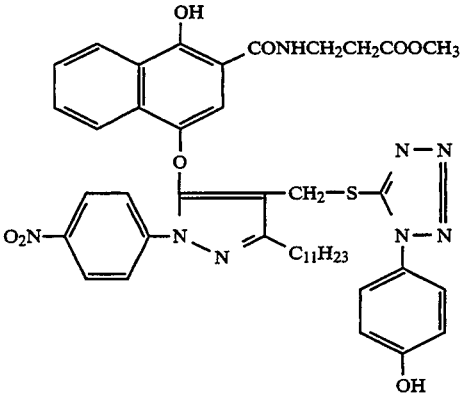
D-3
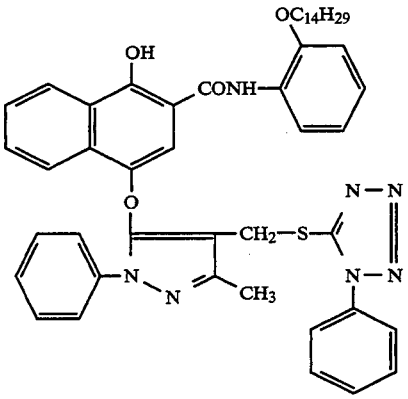
Oil-1
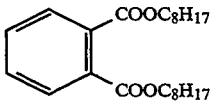
Oil-2
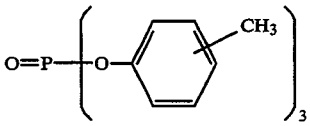
Oil-3
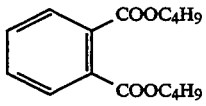
SU-1
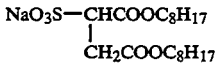

-continued
SU-2
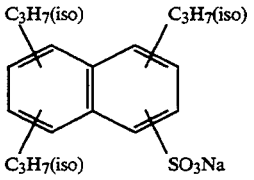
HS-1
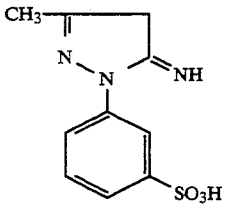
HS-2
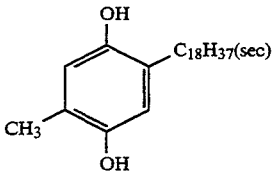
H-1
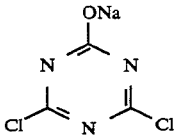
$(CH_2{=}CHSO_2CH_2)_2O$ H-2
UV-1
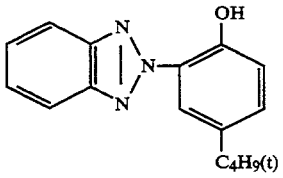
UV-2
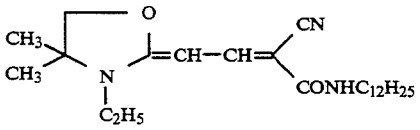
S-1
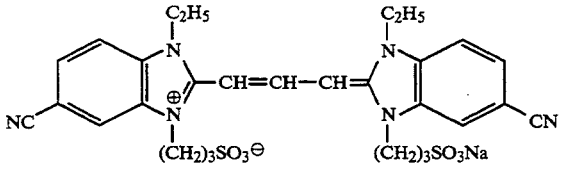
S-2
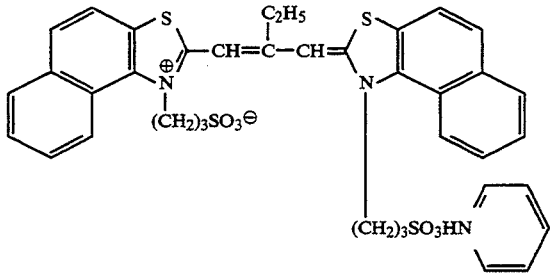

-continued
S-3
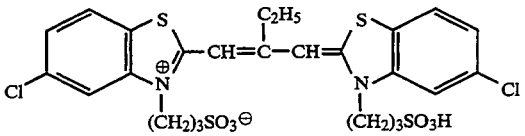
S-4
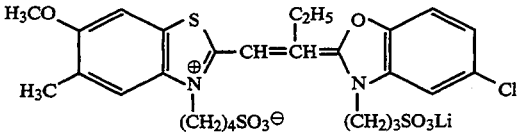
S-5
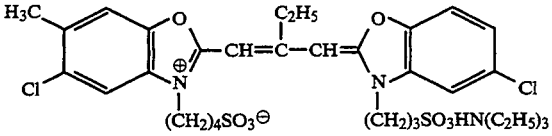
S-6
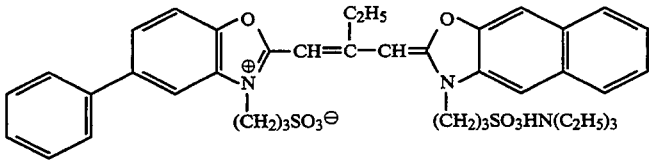
S-7
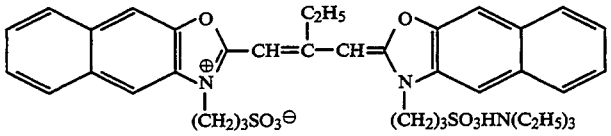
S-8
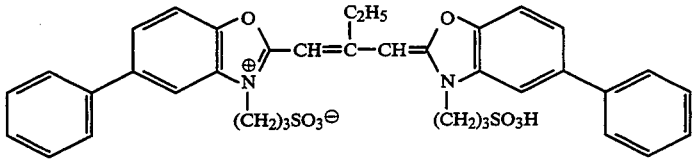
S-9
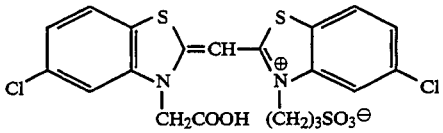
S-10
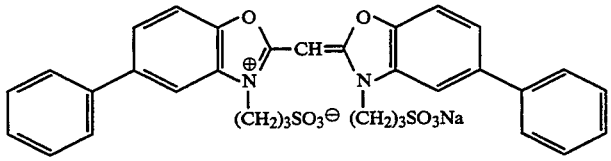
AI-1
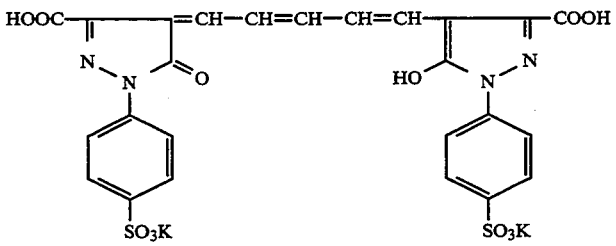

-continued

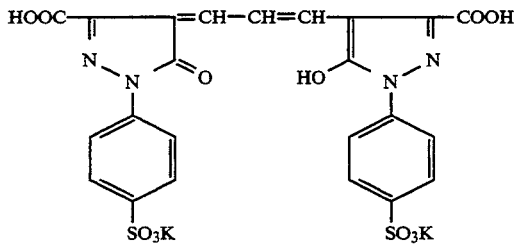

AI-2

Subsequently, multilayered color photographic light-sensitive materials, sample Nos. 2 to 7, were prepared using emulsions EM-2 to EM-7, by turns, in place of emulsion EM-1 used in sample No. 1.

TABLE 4

| Sample | 2 | 3 | 4 | 5 | 6 | 7 |
|---|---|---|---|---|---|---|
| Emulsion Used | EM-2 | EM-3 | EM-4 | EM-5 | EM-6 | EM-7 |

| Process | Processing Time | Processing Temp. |
|---|---|---|
| 1. Color developing | 3 min. 15 sec. | 38.0 ± 0.1° C. |
| 2. Bleaching | 6 min. 30 sec. | 38.0 ± 3.0° C. |
| 3. Washing | 3 min. 15 sec. | 24 – 41° C. |
| 4. Fixing | 6 min. 30 sec. | 38.0 ± 3.0° C. |
| 5. Washing | 3 min. 15 sec. | 24 – 41° C. |
| 6. Stabilizing | 3 min. 15 sec. | 38 ± 3.0° C. |
| 7. Drying | | below 50° C. |

Compositions of the processing solutions used in the respective processes were as follows:

| Color Developer | |
|---|---|
| 4-Amino-3-methyl-N-ethyl-N-(β-hydroxyethyl)-aniline · sulfate | 4.75 g |
| Anhydrous sodium sulfite | 4.25 g |
| Hydroxylamine · ½ sulfate | 20 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |

Water was added to 1 liter, and the pH was adjusted to 10.1.

| Bleach | |
|---|---|
| Ammonium ferric ethylenediaminetetraacetate | 100.0 g |
| Diammonium ethylenediaminetetraacetate | 10.0 g |
| Ammonium bromide | 150.0 g |
| Glacial acetic acid | 10.0 g |

Water was added to 1 liter, and the pH was adjusted to 6.0 with aqueous ammonia.

| Fixer | |
|---|---|
| Ammonium thiosulfate | 175.0 g |
| Anhydrous sodium sulfite | 8.5 g |
| Sodium metasulfite | 2.3 g |

Water was added to 1 liter, and the pH was adjusted to 6.0 with acetic acid.

| Stabilizer | |
|---|---|
| Formalin (37% aqueous solution) | 1.5 ml |
| Koniducks made by Konica Corp. | 7.5 ml |

Water was added to 1 liter.

After preparation of the samples, each of them was immediately evaluated for the relative fog, graininess and pressure desensitization using green light (G). The results are shown in Table 5.

TABLE 5

| | Green-sensitive Layer | | | |
|---|---|---|---|---|
| Sample | Fog | Graininess | Pressure Desensitization | Remarks |
| 1 | 100 | 100 | 100 | Invention |
| 2 | 105 | 108 | 102 | Invention |
| 3 | 103 | 99 | 107 | Invention |
| 4 | 107 | 108 | 191 | Comparison |
| 5 | 172 | 183 | 104 | Comparison |
| 6 | 105 | 104 | 151 | Comparison |
| 7 | 181 | 179 | 199 | Comparison |

The relative fog in the table is a value relative to the minimum density ($D_{min}$) and given by a value obtained by setting the $D_{min}$ value of sample No. 1 as 100. (The larger the value becomes, the larger the deterioration is.)

The graininess is given as a value relative to the standard deviation of variations in density value (RMS value) found when the density of $D_{min}+0.5$ is scanned with a microdensitometer having an opening aperture scanning area of 250 $\mu m^2$. A smaller RMS value indicates a better graininess. In the table, the graininess is shown as a value relative to the RMS value of sample No. 1 which is set at 100. (As the value becomes larger than 100, deterioration in graininess becomes larger.)

The pressure desensitization was determined by the steps of scanning a sample at a constant speed, at 23° C. and 55% relative humidity, using a scratch resistance tester made by Shinto Kagaku Co. with the tester's pointed head having a radius of curvature of 0.025 μm loaded at 5 g, exposing and processing the sample, and then measuring the change in density (ΔDp) at the density of $D_{min}+0.4$, at the place where the load was applied. The pressure desensitization is recorded in ΔDp values relative to the ΔDp value of sample No. 1 which is set at 100. (As the value becomes larger than 100, deterioration becomes heavier.)

As is apparent from Table 5, sample Nos. 1 to 3 of the invention, which contained emulsions EM-1 to EM-3 of the invention respectively, were low in fogging and improved in graininess and, moreover, had a high pressure resistance. Of these samples, sample No. 1 using emulsion EM-1 which best satisfied the combination according to the invention was especially excellent. On the contrary, emulsion EM-4 for comparison was greatly deteriorated in pressure resistance because it had no continuous structure in iodide composition. Emulsion EM-5 was significantly deteriorated in fog and graininess, since the intergrain distance during grain growth largely deviated from the requirements of the invention. Emulsion EM-6 was low in pressure resistance, because its iodide composition, though changed continuously, deviated from the maximum iodide content point ($L_1$) and minimum iodide content point ($L_2$) of the invention. Emulsion EM-7 was greatly deteriorated in both fog and graininess, because it largely deviated from the requirements of continuous change in iodide composition and intergrain distance during grain growth according to the invention.

What is claimed is:

1. A silver halide photographic light-sensitive material comprising a support having thereon a silver halide emulsion layer containing silver halide grains wherein (1) said silver halide grains are grown from seed grains in a reaction liquor, wherein a silver halide phase is formed in each grain while an intergrain distance between individual said silver halide grains in said reaction liquor is maintained at 0.1 to 2.0 μm until 30% of an amount of silver added has been supplied during grain growth, and (2) each of said silver halide grains has a maximum silver iodide content at a distance $L_1$ from its center and a minimum silver iodide content at a distance $L_2$ from its center wherein $L_1$ is less than 0.67 L, $L_2$ is at least 0.58 L, and L is a radial distance from said grain center to a surface of said grains; silver iodide content decreasing substantially uniformly from said distance $L_1$, to said distance $L_2$, and the following relation is satisfied:

$$(L_2 - L_1)/L \geqq 0.20$$

2. The silver halide photographic material of claim 1 wherein the difference between said silver iodide content at said distance $L_1$ and said iodine content at distance $L_2$ is 5 to 40 mol %.

3. The silver halide photographic material of claim 1 wherein said silver halide grains have an even number of parallel twin planes, an average aspect ratio of 1.0 to 5.0, and a ratio (T/I) of average thickness (T) to average shortest spacing (I) between twin planes of at least 5.

4. The silver halide photographic material of claim 1, wherein said silver halide grains are monodispersed.

5. The silver halide photographic material of claim 1, wherein said silver halide grains are silver iodobromide grains having an average silver iodide content of 1 to 20 mol %.

6. A method for preparing a silver halide emulsion comprising silver halide grains, said method comprising:

(a) reacting a silver salt and a halide salt to form silver halide seed grains;

(b) growing silver halide grains in a reaction liquor from said seed grains by addition of a silver salt and a halide salt, wherein an intergrain distance between individual said silver halide grains in said reaction liquor is maintained at 0.1 to 2.0 μm until 30% of said addition is complete during grain growth; and each of said silver halide grains has a maximum silver iodide content at a distance of $L_1$ from its center and a minimum silver iodide content a distance $L_2$ from its center, wherein $L_1$ is 0 to 0.67 L, $L_2$ is 0.58 L to L, and L is a radial distance from said grain center to a surface of said grain; the silver iodide content decreases substantially uniformly from said distance $L_1$ to said distance $L_2$, and the following relation is satisfied.

$$(L_2 - L_1)/L \geqq 0.20$$

7. The method of claim 6 wherein in (b), said silver halide grains are grown further by adding fine grains of silver halide.

8. The method of claim 6 wherein in (b), pAg value of the reaction liquor is maintained within a range of 6 to 12.

* * * * *